US010987931B2

(12) United States Patent
Miyamae

(10) Patent No.: US 10,987,931 B2
(45) Date of Patent: Apr. 27, 2021

(54) IMAGE FORMING APPARATUS AND METHOD FOR CONTROLLING THE SAME

(71) Applicant: KYOCERA Document Solutions Inc., Osaka (JP)

(72) Inventor: Tsubasa Miyamae, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 79 days.

(21) Appl. No.: 16/574,331

(22) Filed: Sep. 18, 2019

(65) Prior Publication Data

US 2020/0108623 A1 Apr. 9, 2020

(30) Foreign Application Priority Data

Oct. 5, 2018 (JP) ..... JP2018-189753

(51) Int. Cl.
*B41J 2/165* (2006.01)
*B41J 2/175* (2006.01)

(52) U.S. Cl.
CPC ..... *B41J 2/16526* (2013.01); *B41J 2/175* (2013.01)

(58) Field of Classification Search
CPC ..... B41J 2/16526; B41J 2/175
See application file for complete search history.

(56) References Cited

U.S. PATENT DOCUMENTS

2002/0085060 A1 7/2002 Usui et al. ..... 347/30
2006/0038862 A1* 2/2006 Tanno ..... B41J 2/17509 347/84

FOREIGN PATENT DOCUMENTS

JP 2005-178397 A 7/2005

* cited by examiner

*Primary Examiner* — Justin Seo
(74) *Attorney, Agent, or Firm* — Stein IP, LLC

(57) ABSTRACT

In an image forming apparatus, a first duct connects a tank to a syringe. A second duct connects the syringe to a damper. A third duct connects the damper to the tank. A liquid surface sensor senses whether or not a liquid surface of the ink in the tank is located at or below a reference position. In a measurement mode, a controller performs injection of the ink into the damper after closing the first and third ducts. The controller opens the third duct after the damper is deformed. Then, the controller closes the second and third ducts. The controller opens the first duct and recognizes a suction amount of the ink sucked from the start of the suction until an output of the liquid surface sensor changes. The controller determines a variation amount based on the suction amount recognized.

10 Claims, 9 Drawing Sheets

IMAGE FORMING APPARATUS AND METHOD FOR CONTROLLING THE SAME

INCORPORATION BY REFERENCE

This application is based upon and claims the benefit of priority from the corresponding Japanese Patent Application No. 2018-189753 filed on Oct. 5, 2018, the entire contents of which are incorporated herein by reference.

BACKGROUND

The present disclosure relates to an image forming apparatus which performs printing by ejecting ink from a nozzle.

There are apparatuses that perform printing with ink. Such printing apparatuses are each provided with a head including a plurality of nozzles. Ink is ejected from the nozzles onto a sheet based on image data. When the ink is consumed, fresh ink is supplied to the head from an ink storage media (a tank). In some of such printing apparatuses, the ink flow path from the tank to the head is configured openable and closable. Regarding this configuration, there has been known the following technology.

Specifically, there is known an inkjet recording apparatus having an ink cartridge attachably and detachably attached in an ink supply path via which ink is supplied, and the ink cartridge has a region formed therein where a flow path is closable. The region of the ink cartridge is pressable, and ink is supplied to a recording head by pressing the region, and with the thereby supplied ink, the recording head performs printing. Then, the recording head is sealed, and a negative pressure is supplied to capping means.

There are cases where a damper is disposed in the middle of an ink flow path from an ink tank to a head. For example, the damper is connected to the head. For example, the damper moderates the variation of pressure applied to the ink inside a nozzle of the head. This helps reduce irregular ink ejection.

On the other hand, ink includes a vaporable component. If a nozzle is left unused (in other words, does not eject ink) for a long time, the ink in the nozzle becomes increasingly viscous (condensed) due to the evaporation of the vaporable component. The increasingly viscous (dried) ink sometimes causes poor ink ejection. Further, dust or fine particles adhered to a nozzle may prevent the nozzle from ejecting ink. To prevent such failures, there are cases where cleaning is performed to forcibly eject ink from nozzles. The cleaning helps prevent occurrence of such failures. Further, there are cases where even if a failure occurs, the failure can be cleared.

To perform forcible ink discharge, ink is sent out of an ink tank. For example, a pump is used to push the ink into a head with a strong force (a high pressure). The high pressure pushes the ink out of the nozzles of the head. Thereby, the highly viscous ink is pushed out of the nozzles. Dust and fine particles are washed away from the nozzles.

In a case where forcible ink discharge is performed, the pressure applied to the ink sometimes caused deformation of the damper. When the damper has a withstanding pressure lower than the pressure applied to the ink, the damper is deformed (expanded). The expanded damper has an increased capacity. As a result of the deformation of the damper, it sometimes happens that the amount of forcibly ejected ink is reduced. If the reduction of the amount is too great, it is impossible to obtain a sufficient effect of cleaning. On the other hand, there are individual differences in the deformation amount (the capacity variation amount) among different dampers. The capacity variation amount differs from damper to damper. To obtain a sufficient effect of cleaning, it is disadvantageously necessary to accurately measure the amount of variation in damper capacity (the amount of variation in damper ink capacity) caused by the deformation. Note that the above-described known technology is not related to damper deformation.

SUMMARY

According to an aspect of the present disclosure, an image forming apparatus includes a head, a tank, a syringe, a damper, a first duct, a second duct, a third duct, a liquid surface sensor, and a controller. The head performs printing by ejecting ink. The tank stores the ink therein. The syringe performs injection or suction of the ink. The damper supplies the ink to the head, and the ink is injected into the damper from the syringe. The first duct is a flow path that connects the tank and the syringe to each other for conveyance of the ink between the tank and the syringe. The second duct is a flow path that connects the syringe and the damper to each other for conveyance of the ink between the syringe and the damper. The third duct is a flow path that connects the damper and the tank to each other for conveyance of the ink between the damper and the tank. The liquid surface sensor senses whether or not a liquid surface of the ink in the tank is located at or below a reference position. The controller receives an output of the liquid surface sensor. In a measurement mode, in which a variation amount indicating an amount of variation in ink capacity of the damper caused by deformation of the damper is measured, the controller performs pressure applying processing, pressure releasing processing, and liquid surface lowering processing. The controller performs the pressure releasing processing after the pressure applying processing. In the pressure applying processing, the controller closes the first duct and the third duct. Then, the controller makes the syringe perform the injection of the ink into the damper to cause deformation of the damper. After the damper is deformed, the controller, in the pressure releasing processing, makes the syringe stop injecting the ink into the damper. The controller opens the third duct. After the pressure releasing processing, the controller performs the liquid surface lowering processing. In the liquid surface lowering processing, the controller closes the second duct and the third duct. The controller, with the first duct open, makes the syringe perform the suction of the ink from the tank. The controller recognizes a suction amount of the ink sucked by the syringe from a start of the suction of the ink until an output of the liquid surface sensor changes. The controller determines the variation amount based on the suction amount recognized.

According to another aspect of the present disclosure, a method for controlling an image forming apparatus includes performing printing by ejecting ink from a head, storing the ink in a tank, performing injection or suction of the ink by using a syringe, supplying the ink from a damper to the head and injecting the ink from the syringe into the damper, a first duct connecting the tank and the syringe to each other, a second duct connecting the syringe and the damper to each other, a third duct connecting the damper and the tank to each other, sensing whether or not a liquid surface of the ink in the tank is located at or below a reference position by using a liquid surface sensor, performing pressure applying processing, pressure releasing processing, and liquid surface lowering processing in a measurement mode, in which a variation amount indicating an amount of variation in ink capacity of the damper caused by deformation of the damper is measured, performing the pressure releasing processing after the pressure applying processing, in the pressure applying processing, closing the first duct and the third duct and then the syringe performing the injection of the ink into the damper to deform the damper, in the pressure releasing processing performed after the damper is deformed, the syringe stopping the injection of the ink into the damper and opening the third duct, performing the liquid surface lowering processing after the pressure releasing processing, in the liquid surface lowering processing, closing the second duct and the third duct, the syringe performing the suction of the ink from the tank, and recognizing a suction amount of the ink sucked by the syringe from a start of the suction until an output of the liquid surface sensor changes, and determining the variation amount based on the suction amount recognized.

Further features and advantages of the present disclosure will become apparent from the description of embodiments given below.

DETAILED DESCRIPTION

Figure 1:
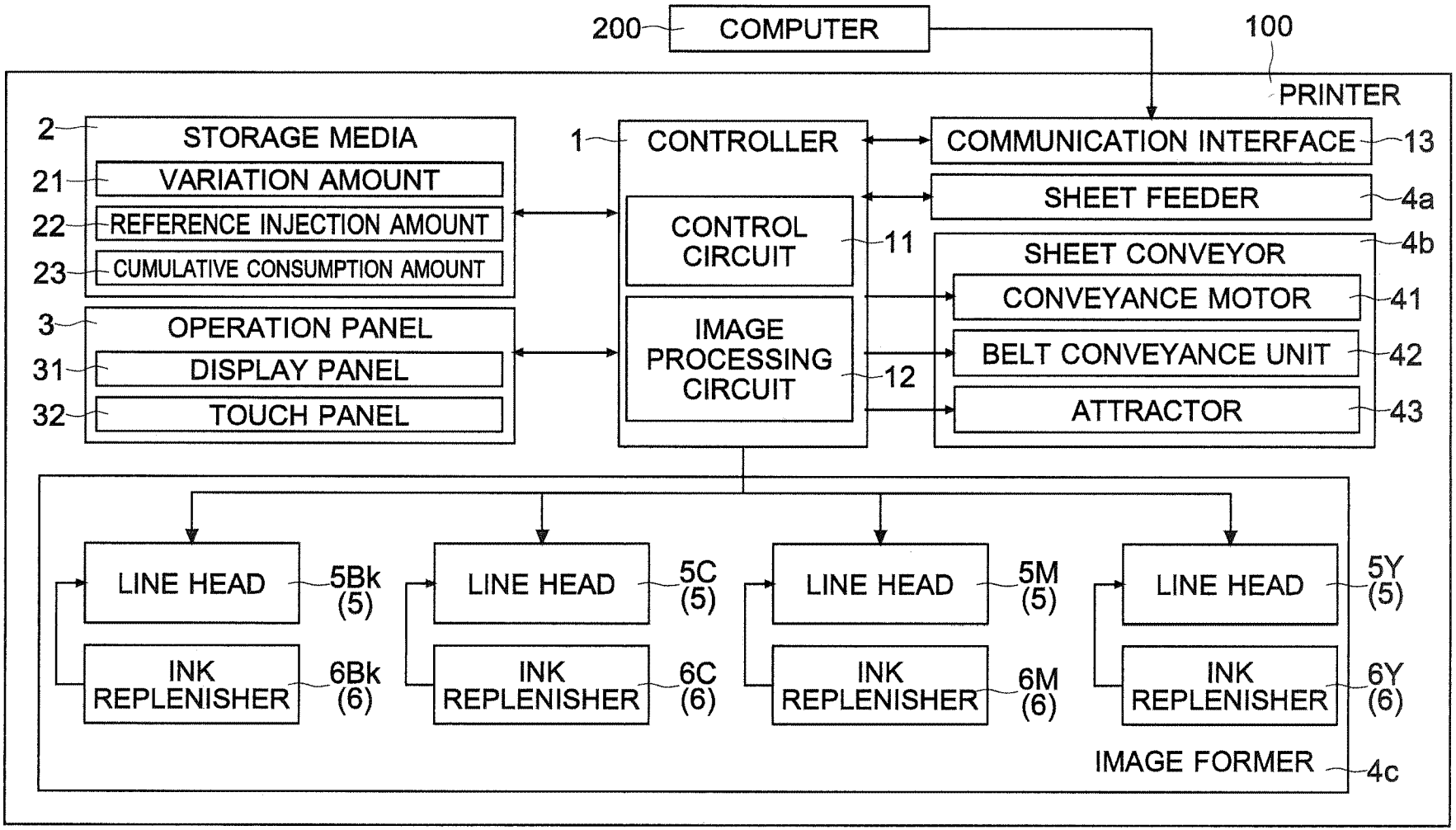
FIG. 1 is a diagram showing an example of a printer according to an embodiment.

The present disclosure accurately measures the amount of variation caused in damper capacity by deformation of the damper occurring when pressure is applied to ink. Hereinafter, with reference to FIG. 1 to FIG. 12, an embodiment of the present disclosure will be described. The following description will deal with a printer 100 as an example of an image forming apparatus. The printer 100 (an inkjet printing apparatus) performs printing with ink. It should be understood that all the features, in terms of structure, arrangement, and the like, described in connection with the embodiment are merely examples for the sake of description, and are in no way meant to limit the scope of the disclosure.

(Outline of Printer 100)

First, a description will be given of the outline of the printer 100 according to the embodiment, with reference to FIG. 1. The printer 100 includes a controller 1 (control board). The controller 1 controls each portion of the printer 100. The controller 1 includes a control circuit 11 and an image processing circuit 12. For example, the control circuit 11 is a CPU. The control circuit performs operations and processing based on a control program and control data stored in a storage media 2. The storage media 2 includes a nonvolatile storage device, such as a ROM, an HDD, and a flash ROM, and a volatile storage device, such as a RAM. The image processing circuit 12 performs image processing on image data. The image processing circuit 12 generates image data (image data for ink ejection) to be used in printing. The image data for ink ejection is data for instructing whether or not to eject ink with respect to each nozzle 51 (pixel).

The printer 100 includes an operation panel 3. The operation panel 3 includes a display panel 31 and a touch panel 32. The display panel 31 displays a setting screen and information. The display panel 31 displays operation images such as of a key, a button, and a tab. The touch panel 32 detects a touch operation performed with respect to the display panel 31. Based on the output of the touch panel 32, the controller 1 recognizes an operated one of the operation images. The control unit 1 thus recognizes a setting operation performed by a user.

The printer 100 includes a sheet feeder 4*a*, a sheet conveyor 4*b*, and an image former 4*c*. The sheet feeder 4*a* has a stack of sheets placed thereon. In a print job, the controller 1 makes the sheet feeder 4*a* perform sheet feeding. The controller 1 makes the sheet conveyor 4*b* perform sheet conveyance. The sheet conveyor 4*b* includes a conveyance motor 41 and a sheet conveying rotation body. The controller 1 makes the conveyance motor 41 rotate. The rotation of the conveyance motor 41 causes the sheet conveying rotation body to rotate. Thereby, a sheet fed from the sheet feeder 4*a* is conveyed toward a discharge tray (not shown).

The sheet conveyor 4*b* includes a belt conveyance unit 42 and an attractor 43. The belt conveyance unit 42 conveys a sheet. The belt conveyance unit 42 includes a conveyance belt. The conveyance belt is rotatable. A sheet is conveyed on the conveyance belt. Above the belt conveyance unit 42, the image former 4*c* is provided. The image former 4*c* is disposed to be above the sheet placed on the conveyance belt. The attractor 43 is provided in the belt conveyance unit 42. By being attracted by the attractor 43, the sheet on the conveyance belt does not shift its position. Further, the controller 1 makes the sheet conveyor 4*b* perform discharging of the sheet after recording (printing) is performed on the sheet.

The image former 4*c* ejects ink onto the sheet placed on the conveyance belt, and thereby records (prints) an image on the sheet. As shown in FIG. 1, the printer 100 includes four line heads 5 (5Bk, 5C, 5M, 5Y) corresponding to four colors. The line heads are stationary. The positions of the line heads 5 do not change. The line heads 5 are arranged to be above the sheet under conveyance. The line head 5Bk ejects black ink. The line head 5C ejects cyan ink. The line head 5M ejects magenta ink. The line head 5Y ejects yellow ink.

Ink replenishers 6 (6Bk, 6C, 6M, 6Y) are provided each to supply ink to a corresponding one of the line heads 5. The ink replenisher 6Bk supplies the black ink to the line head 5 for black. The ink replenisher 6C supplies the cyan ink to the line head 5 for cyan. The ink replenisher 6M supplies the magenta ink to the line head 5 for magenta. The ink replenisher 6Y supplies the yellow ink to the line head 5 for yellow.

The printer 100 includes a communication interface 13. The communication interface 13 includes communication hardware (a connector, a communication circuit) and communication software. The communication interface 13 communicates with a computer 200. The computer 200 is a personal computer or a server, for example. The controller 1 receives printing data from the computer 200. The printing data includes settings for printing and contents to be printed. For example, the printing data includes data described in a page description language. Based on the received printing data, the controller 1 (the image processing circuit 12) generates image data (raster data) to be used for image formation performed in the image former 4*c*. The image processing circuit 12 processes the raster data to generate image data for ink ejection.

(Ink Ejection Control)

Next, with reference to FIG. 2, a description will be given of an example of ink ejection control performed in the printer 100 according to the embodiment. The line head 5 for each color includes two or more (a plurality of) heads 50. The line head 5 is formed by combining the plurality of heads 50. Each head 50 has a smaller length in a main scanning direction (a direction perpendicular to a sheet conveyance direction) than each line head 5. The line head 5 for each color is formed by arranging the heads 50 in a staggered manner, for example. The recording heads 50 each include a plurality of nozzles 51. The nozzles 51 are arranged in a row. The heads 50 are each fixed such that the nozzles 51 are arranged in a row in the direction perpendicular to the sheet conveyance direction.

Figure 2:
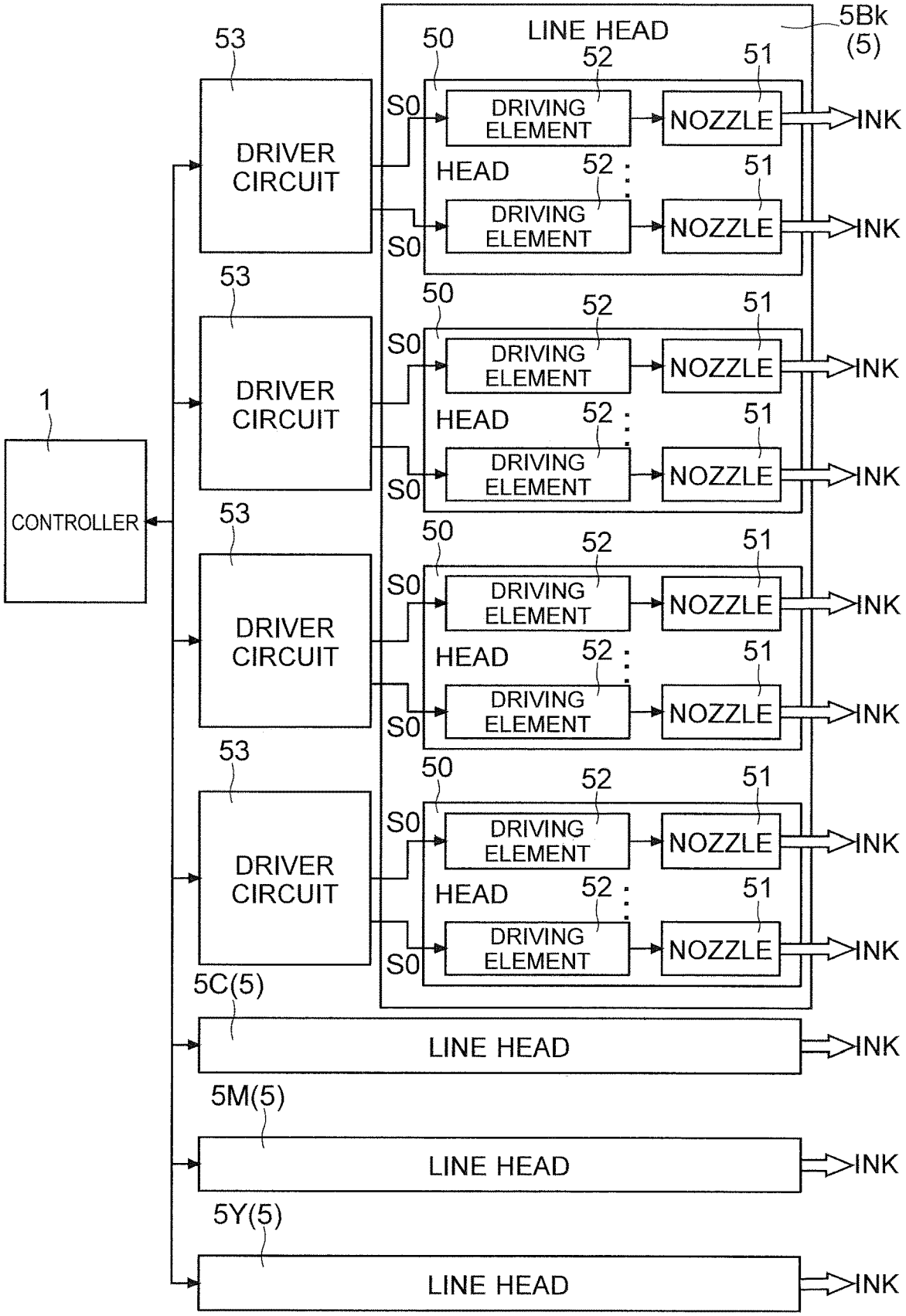
FIG. 2 is a diagram showing an example of how ink ejection is controlled in the printer according to the embodiment.

As shown in FIG. 2, the recording heads 50 each include a plurality of nozzles 51. For example, the nozzles 51 are formed by etching or boring a metal sheet. The nozzles 51 are formed at regular intervals in the main scanning direction. The interval between each two adjacent ones of the nozzles 51 in the main scanning direction determines a pixel-to-pixel pitch. The openings of these nozzles 51 face a sheet under conveyance. With respect to each nozzle 51, one driving element 52 is provided. The driving element 52 is a piezoelectric element (a piezo element). Thus, the heads 50 are each provided with a plurality of the nozzles 51 which eject ink and a plurality of the driving elements 52 which make the nozzles 51 eject ink.

Figure 3:
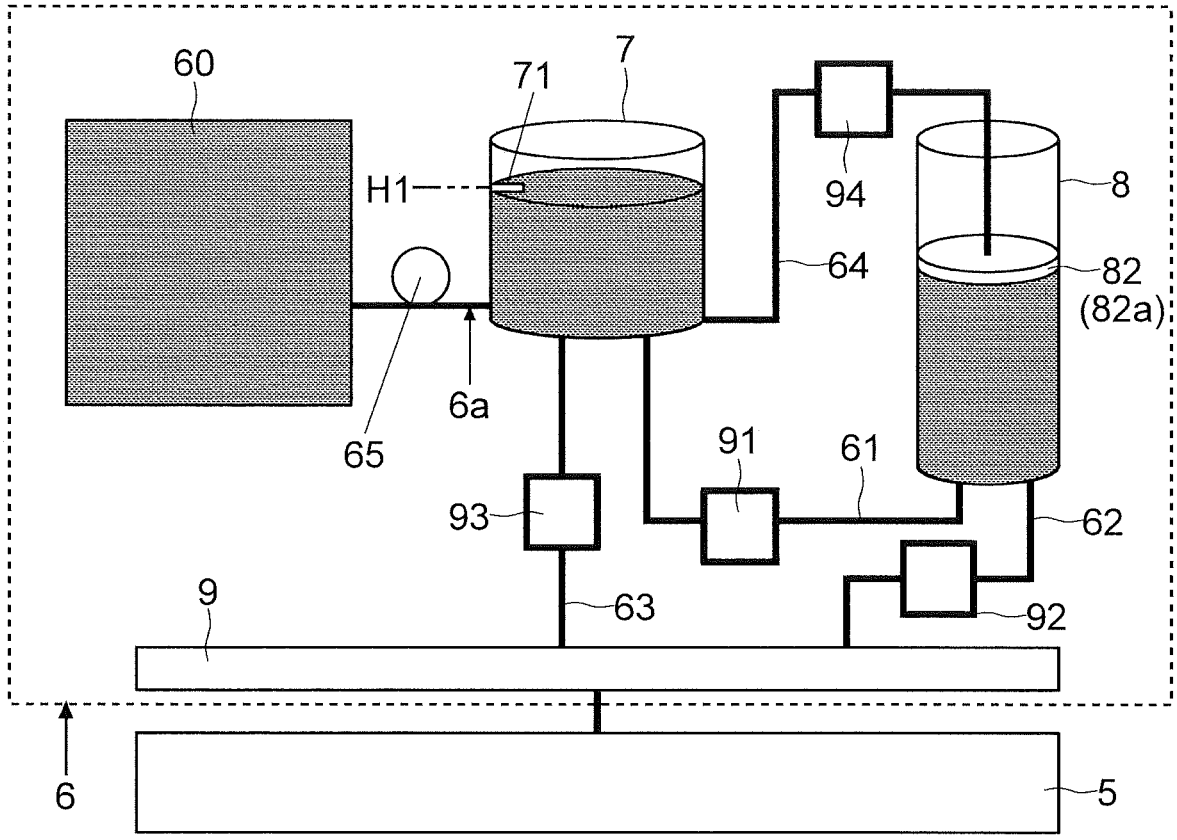
FIG. 3 is a diagram showing an example of an ink replenisher according to the embodiment.

A plurality of driver circuits 53 are provided one for each, or one for two or more, of the plurality of heads 50. FIG. 3 shows a case where a plurality of the driver circuits 53 are provided one for each head 50. Or, one driver circuit 53 may control two or more of the heads 50, instead. The driver circuit 53 feeds an ejection signal S0 to the driving element 52 of a nozzle 51 from which ink is to be ejected. The ejection signal S0 has a pulse waveform. By the application of the ejection signal S0, the driver circuit 53 controls the ejection of ink from the nozzle 51. The driving element 52 is deformed when voltage is applied thereto. Pressure caused by the deformation is applied to the nozzle 51 and to a flow path through which ink is to be supplied to the nozzle 51. The thus applied pressure causes the ink to be ejected from the nozzle 51. The ink impacts on the sheet under conveyance. Thereby, an image is formed (recorded) on the sheet.

In printing, the controller 1 (the control circuit 11, the image processing circuit 12) makes the driver circuit 53 cause ink to be ejected from the nozzles. Here, the controller 1 does not make the driver circuit 53 apply voltage to such a driving element 52 as corresponds to a pixel at which no ink is to be ejected. The controller 1 (the image processing circuit 12) generates image data for ink ejection for each of the line heads 5 (that is, for each color). The controller 1 transmits the generated image data to each of the heads 50. The image data for ink ejection is data (binary data) for instructions on whether or not to eject ink with respect to each pixel of each line. The controller 1 (the image processing circuit 12) transmits the image data for ink ejection to each driver circuit 53 on a line-by-line basis in the main scanning direction.

The driver circuit 53, based on the image data for ink ejection, feeds the ejection signal S0 (applies voltage) to a driving element 52 that corresponds to a nozzle 51 from which ink is to be ejected. Note that, for the sake of convenience, an interior of only the line head 5Bk of the plurality of line heads 5 is illustrated in FIG. 2. The line heads 5 for the different colors are similar to each other in configuration.

The controller 1 may feed a clock signal to each of the driver circuits 53. Based on the clock signal, an ink-ejection cycle (frequency) is determined. In a print job, the ejection signal S0, which is fed to the driving elements 52 by the driver circuits 53, has a constant frequency (voltage-application frequency). The sheet is conveyed at a sheet conveyance speed such that the sheet moves by a distance corresponding to one dot (one line) in one ink-ejection cycle. The controller 1 makes the sheet conveyor 4*b* convey the sheet at a predetermined sheet conveyance speed. Based on the image data, the driver circuit 53 applies voltage to a driving element 52 that corresponds to a pixel (a nozzle 51) at which ink is to be ejected. This processing is repeated from top to bottom of a page in the sheet conveyance direction (a sub scanning direction), and thereby one page is printed.

(Ink Replenisher 6)

Next, a description will be given of an example of the ink replenishers 6 according to the embodiment, with reference to FIG. 3 to FIG. 6. The ink replenishers 6 are provided one for each of the line heads 5. FIG. 3 shows the ink replenisher 6 for one of the line heads 5 for the four colors. The ink replenishers 6 in the line heads 5 for the four colors are similar to each other in configuration. The same description is applicable to all the ink replenishers 6. Thus, in the following description, the signs Bk, C, M, and Y, which indicate the four colors, will be omitted.

The ink replenisher 6 includes an ink container 60, a tank 7, a syringe 8, a damper 9, a replenishment pipe 6*a*, a first duct 61, a second duct 62, a third duct 63, a fourth duct 64, a liquid surface sensor 71, and a pump 65.

The ink container 60 contains ink to be replenished to the line head 5. The ink container 60 for black contains black ink. The ink container 60 for cyan contains cyan ink. The ink container 60 for magenta contains magenta ink. The ink container 60 for yellow contains yellow ink.

The ink container 60 is connected to the tank 7 via the replenishment pipe 6*a*. The replenishment pipe 6*a* functions as an ink flow path from the ink container 60 to the tank 7. Via the replenishment pipe 6*a*, the ink in the ink container 60 is sent into the tank 7. The tank 7 stores the ink therein. The maximum ink capacity of the tank 7 is smaller than that of the ink container 60.

Inside the tank 7, the liquid surface sensor 71 is provided. The liquid surface sensor 71 is a sensor for sensing whether or not a position (a height) of the surface of the ink inside the tank 7 is at or below a reference position H1. The reference position H1 indicates the height of the liquid surface to be maintained in the tank 7. For example, the reference position H1 is at a height that is three-fourths of the entire height of the tank 7.

When the liquid surface is located above the reference position H1, the liquid surface sensor 71 outputs a first-level voltage. When the liquid surface is located at or below the reference position H1, the liquid surface sensor 71 outputs a second-level voltage. When the first level is High level, the second level is Low level. When the first level is Low level, the second level is High level.

The output of the liquid surface sensor 71 is fed to the controller 1. The controller 1 is capable of recognizing whether or not the position (the height) of the liquid surface is at or below the reference position H1 based on an output level of the liquid surface sensor 71. When the liquid surface in the tank 7 has descended to or below the reference position H1 (that is, when the output level of the liquid surface sensor 71 has become the second level), the controller 1 makes the pump 65 operate. The pump 65 operates to send the ink from the ink container 60 into the tank 7. The controller 1 makes the pump 65 continue to operate until the output level of the liquid surface sensor 71 changes to the first level. When the output level of the liquid surface sensor 71 has changed to the first level, the controller 1 makes the pump 65 stop operating. The height of the liquid surface in the tank 7 is thus maintained at the reference position H1.

The syringe 8 performs injection or suction of the ink. For example, the syringe 8 sucks (draws up) the ink from the tank 7. The syringe 8 injects (pushes out) the ink into the damper 9. The damper 9 receives the ink from the syringe 8. The ink in the damper 9 is supplied to each of the heads 50 of the line head 5. In other words, the ink in the damper 9 is supplied into the nozzles 51, and ink flow paths provided inside the line head 5. Further, the damper 9 moderates variation of pressure applied to the ink. It is thus possible to reduce variation of the amount of ink ejected when the driving element 52 is made to operate.

The plurality of ducts are provided for the purpose of conveying (passing) the ink between the tank 7, the syringe 8, and the damper 9. The ducts each function as an ink flow path. The first duct 61 connects the tank 7 to the syringe 8. The ink directed from the tank 7 to the syringe 8, or from the syringe 8 to the tank 7 from the syringe 8, passes through the first duct 61. The second duct 62 connects the syringe 8 to the damper 9. The ink directed from the syringe 8 to the damper 9, or from the damper 9 to the syringe 8, passes through the second duct 62. The third duct 63 connects the damper 9 to the tank 7. The ink directed from the damper 9 to the tank 7 passes through the third duct 63.

Further, one end of the fourth duct 64 is connected to the syringe 8. The fourth duct 64 is a pipe for releasing air from inside the syringe 8. The other end of the fourth duct 64 is connected to the tank 7. The air having been released from the syringe 8 is blown into the tank 7. The air having been blown into the tank 7 floats up as bubbles. The released air thus eventually mixes with air that is present above the liquid surface.

The printer 100 (the ink replenisher 6) includes a first opening-closing portion 91, a second opening-closing portion 92, a third opening-closing portion 93, and a fourth opening-closing portion 94. The first opening-closing portion 91 performs opening and closing of the first duct 61 (bringing the ink flow path into a communicating state and a cut-off state). The second opening-closing portion 92 performs opening and closing of the second duct 62 (bringing the ink flow path into a communicating state and a cut-off state). The third opening-closing portion 93 performs opening and closing of the third duct 63 (bringing the ink flow path into a communicating state and a cut-off state). The fourth opening-closing portion 94 performs opening and closing of the fourth duct 64 (bringing the air flow path into a communicating state and a cut-off state).

Figure 4:
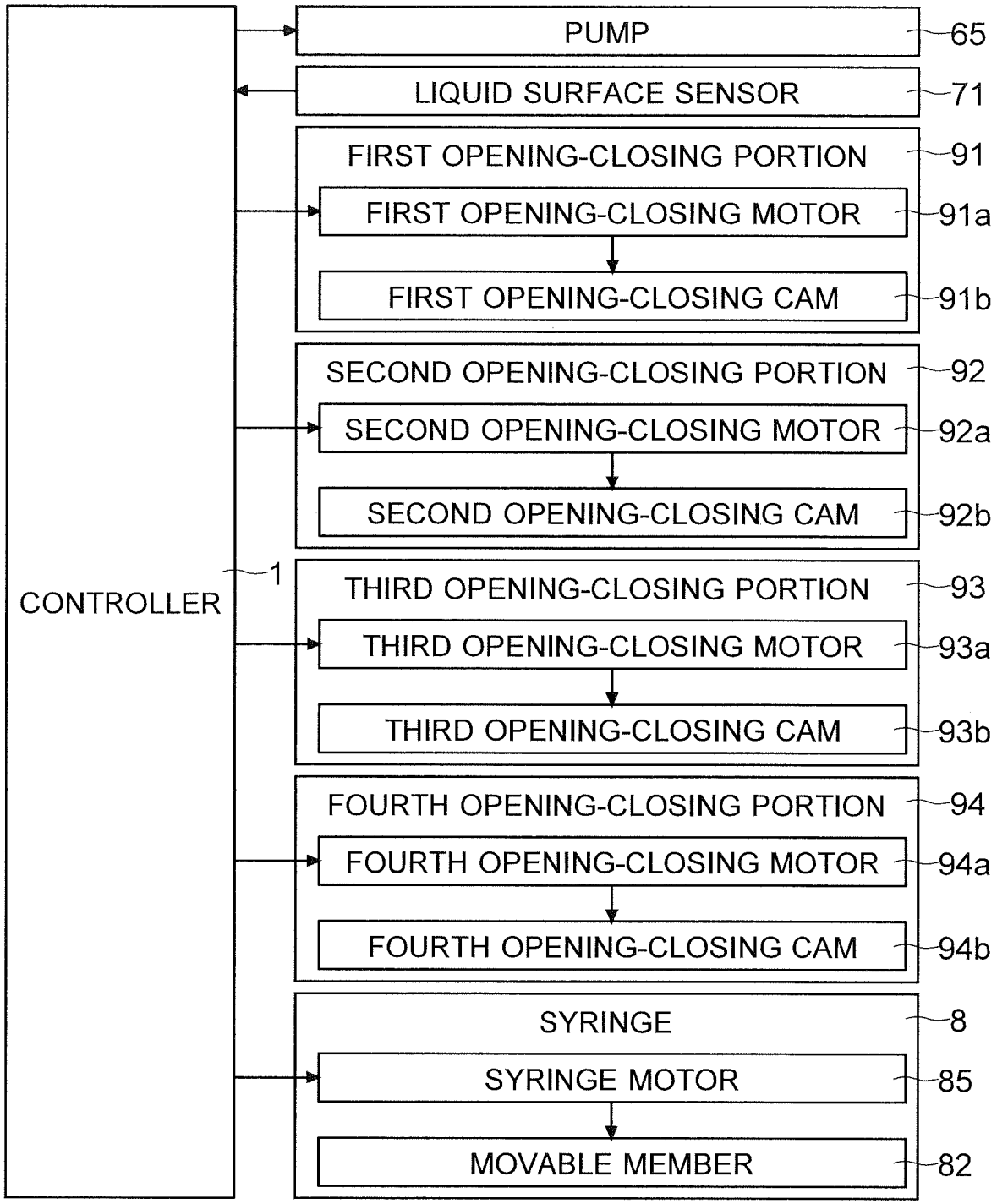
FIG. 4 is a diagram showing the example of the ink replenisher according to the embodiment.

As shown in FIG. 4, in order to perform operations of bringing the first duct 61 into the communicating state and the cut-off state, the first opening-closing portion 91 includes a first opening-closing motor 91*a* and a first opening-closing cam 91*b*. In order to perform operations of bringing the second duct 62 into the communicating state and the cut-off state, the second opening-closing portion 92 includes a second opening-closing motor 92*a* and a second opening-closing cam 92*b*. In order to perform operations of bringing the third duct 63 into the communicating state and the cut-off state, the third opening-closing portion 93 includes a third opening-closing motor 93*a* and a third opening-closing cam 93*b*. In order to perform operations of bringing the fourth duct 64 into the communicating state and the cut-off state, the fourth opening-closing portion 94 includes a fourth opening-closing motor 94*a* and a fourth opening-closing cam 94*b*.

The first duct 61, the second duct 62, the third duct 63, and the fourth duct 64 are each, for example, a rubber tube, and thus can be bent or warped. They can also be squeezed (pressed from above) to thereby block the flow of substance (ink, air) that exists inside thereof.

Figure 5:
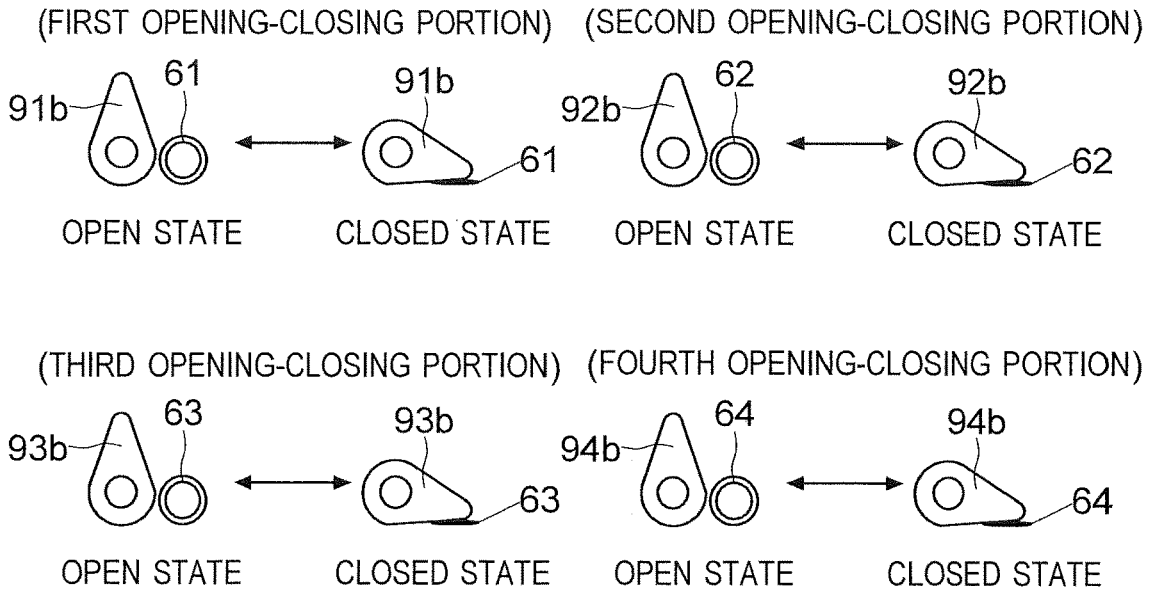
FIG. 5 is a diagram showing examples of opening-closing portions according to the embodiment.

As shown in FIG. 5, to open (to let the ink flow through) the first duct 61, the controller 1 rotates (controls) the first opening-closing motor 91*a*. The controller 1 rotates the first opening-closing cam 91*b* by a rotation angle that does not cause the first opening-closing cam 91*b* to squeeze (press, contact) the first duct 61. To close (to block the flow of the ink through) the first duct 61, the controller 1 rotates (controls) the first opening-closing motor 91*a*. The controller 1 rotates the first opening-closing cam 91*b* by a rotation angle that causes the first opening-closing cam 91*b* to squeeze (press) the first duct 61.

To open (to let the ink flow through) the second duct 62, the controller 1 rotates (controls) the second opening-closing motor 92*a*. The controller 1 rotates the second opening-closing cam 92*b* by a rotation angle that does not cause the second opening-closing cam 92*b* to squeeze (press, contact) the second duct 62. To close (to block the flow of the ink through) the second duct 62, the controller 1 rotates (controls) the second opening-closing motor 92*a*. The controller 1 rotates the second opening-closing cam 92*b* by a rotation angle that causes the second opening-closing cam 92*b* to squeeze (press) the second duct 62.

To open (to let the ink flow through) the third duct 63, the controller 1 rotates (controls) the third opening-closing motor 93*a*. The controller 1 rotates the third opening-closing cam 93*b* by a rotation angle that does not cause the third opening-closing cam 93*b* to squeeze (press, contact) the third duct 63. To close (to block the flow of the ink through) the third duct 63, the controller 1 rotates (controls) the third opening-closing motor 93*a*. The controller 1 rotates the third opening-closing cam 93*b* by a rotation angle that causes the third opening-closing cam 93*b* to squeeze (press) the third duct 63.

To open (to let air flow through) the fourth duct 64, the controller 1 rotates (controls) the fourth opening-closing motor 94*a*. The controller 1 rotates the fourth opening-closing cam 94*b* by a rotation angle that does not cause the fourth opening-closing cam 94*b* to squeeze (press, contact) the fourth duct 64. To close (to block the flow of the ink through) the fourth duct 64, the controller 1 rotates (controls) the fourth opening-closing motor 93*a*. The controller 1 rotates the fourth opening-closing cam 94*b* by a rotation angle that causes the fourth opening-closing cam 9*bb* to squeeze (press) the fourth duct 64.

Next, with reference to FIG. 3 and FIG. 6, the syringe 8 will be described. The syringe 8 includes, for example, an ink cylinder 81 and a movable member 82 (a plunger). For example, the ink cylinder 81 has a circular cylindrical shape. The ink cylinder 81 has an open top. The ink cylinder 81 has the first duct 61 and the second duct 62 connected to its bottom.

Figure 6:
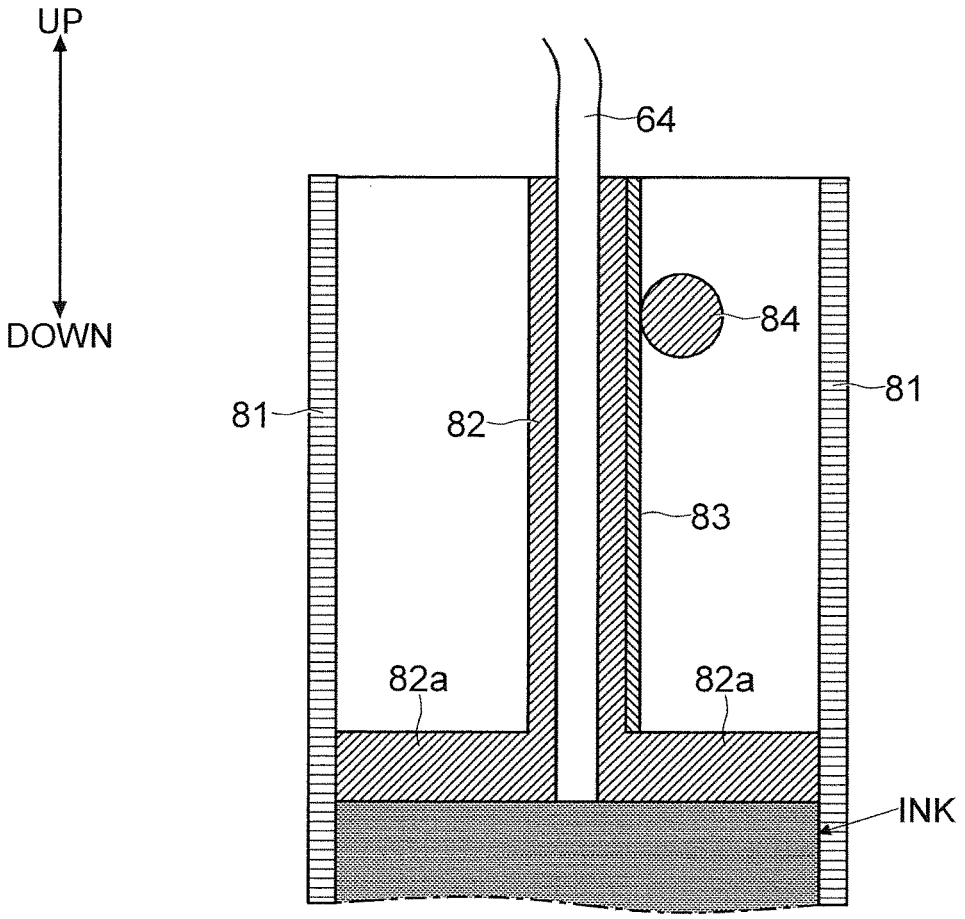
FIG. 6 is a diagram showing an example of a syringe according to the embodiment.

As shown in FIG. 6, the movable member 82 is inserted inside the ink cylinder 81 from above the ink cylinder 81. The movable member 82 is reverse T-shaped in vertical section. That is, the movable member 82 has a shape similar to the shape of a plunger of an injector. A leading end part (a lower side part) of the movable member 82 is formed as an airtight sealing portion 82*a*. The bottom surface of the airtight sealing portion 82*a* (the movable member 82) has substantially the same shape as the inside bottom of the ink cylinder 81. The airtight sealing portion 82*a* is a member for achieving airtightness, such as a seal. The airtight sealing portion 82*a* does not allow the ink inside thereof from leaking over the top thereof.

The fourth duct 64 is inserted through the movable member 82 at an inner part (at a center) of the movable member 82. The fourth duct 64 is placed through the movable member 82, from the uppermost part through the bottom surface of the movable member 82. When the movable member 82 moves downward, air present under the movable member 82 inside in the ink cylinder 81 is released through the fourth duct 64. Then, the top surface of the ink inside the ink cylinder 81 comes into contact with the lower surface of the airtight sealing portion 82*a*. A vertical side surface of the movable member 82 is provided with a toothed surface 83. The toothed surface 83 has teeth arranged in the vertical direction. Provided to mesh with these teeth is a gear 84. A syringe motor 85 is provided to rotate the gear 84. The syringe motor 85 is rotatable forwardly and reversely. By rotating the syringe motor 85, it is possible to vertically move the movable member 82.

To inject (push out) the ink from the syringe 8 into the tank 7 or the damper 9, the controller 1 rotates the syringe motor 85 in a direction for causing the movable member 82 to move downward. To increase the amount of ink in the syringe 8 (by sucking), the controller 1 rotates the syringe motor 85 in a direction for causing the movable member 82 to move upward. Here, in injecting the ink or sucking the ink, the controller 1 closes (cuts off) the fourth duct 64. Before injecting the ink or sucking the ink, the controller 1 opens the fourth duct 64 and makes the movable member 82 move to release air from inside the ink cylinder 81.

Further, the area of the bottom (a horizontal sectional area) of the ink cylinder 81 is fixed. By multiplying the bottom area with the movement amount (height) of the movable member 82, the controller 1 is able to recognize the amount of ink injected or sucked. For example, the syringe motor 85 may be a stepping motor. The controller 1 recognizes a downward movement amount of the movable member 82 based on the number of rotations (the rotation angle) of the syringe motor 85 performed from the start till the end of injection. By multiplying the downward movement amount by the bottom area, the controller 1 recognizes the amount of ink injected.

Likewise, by multiplying the bottom area by the movement amount (height) of the movable member 82, the controller 1 is able to recognize the amount of ink sucked. The controller 1 recognizes an upward movement amount of the movable member 82 based on the number of rotations (the rotation angle) of the syringe motor 85 performed from the start till the end of sucking. By multiplying the upward movement amount by the bottom area, the controller 1 recognizes the amount of ink sucked.

(Deformation of Damper 9)

Figure 7:
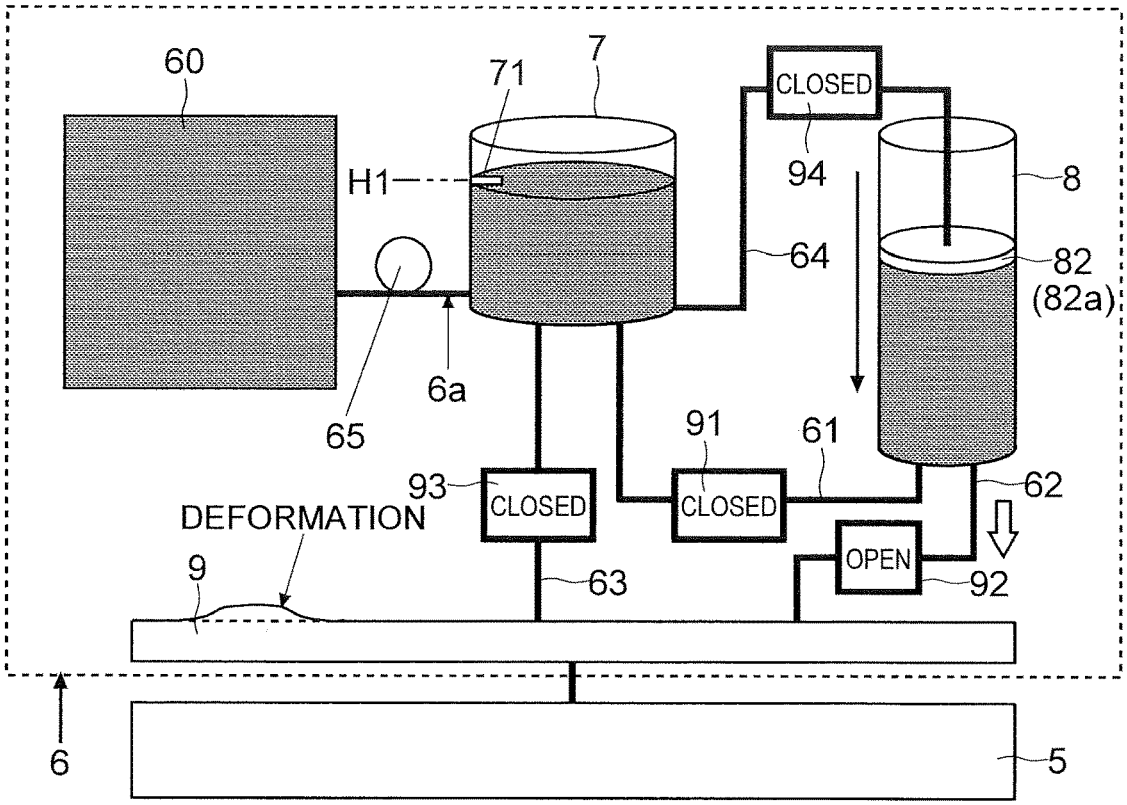
FIG. 7 is a diagram showing an example of deformation of a damper according to the embodiment.

Next, with reference to FIG. 7, a description will be given of an example of deformation of the damper 9 according to the embodiment. The printer 100 is able to perform forcible ink discharge processing. In the forcible ink discharge processing, pressure is applied to the ink. For pressure application, ink is injected into the damper 9 from the syringe 8. Thereby, ink flows out of the nozzles 51 of the line head 5. Through the forcible ink discharge processing, it is possible to discharge highly condensed, highly viscous, residual ink from the nozzles 51. Further, the forcible ink discharge processing sometimes helps remove dust adhered on the nozzles 51.

Here, the belt conveyance unit 42 is vertically movable. The printer 100 includes an elevator mechanism for vertically moving the belt conveyance unit 42. To perform the forcible ink discharge processing, the controller 1 moves the belt conveyance unit 42 downward. The controller 1 increases the distance between the line head 5 (the nozzles 51) and the conveyance belt. The controller 1 puts an ink receiving tray in the created space. The printer 100 includes a moving mechanism for moving the ink receiving tray. The ink receiving tray receives discharged ink. For example, the ink receiving tray is provided with an ink absorbing sponge. After the forcible ink discharge processing is performed, the controller 1 retracts the ink receiving tray. The controller 1 moves the belt conveyance unit 42 upward. The controller 1 thereby moves the belt conveyance unit 42 back to its original position.

The controller 1 may perform the forcible ink discharge processing when the operation panel 3 has received an instruction to execute the forcible ink discharge processing. Further, the controller 1 may perform the forcible ink discharge processing every time the printer 100 has performed printing on a predetermined number of sheets. Further, the controller 1 may perform the forcible ink discharge processing at a previously set time.

In performing the forcible ink discharge processing, the controller 1 applies pressure to the ink to be injected into the line head 5. The pressure applied to the ink at this time is greater than that in the normal ink ejection. To apply pressure to the ink, the controller 1 cuts off (closes) the first duct 61 (the first opening-closing portion 91) and the third duct 63 (the third opening-closing portion 93) (see FIG. 7). The controller 1 also cuts off (closes) the fourth duct 64 (the fourth opening-closing portion 94). On the other hand, in order to send the ink into the line head 5, the controller 1 brings the second duct 62 (the second opening-closing portion 92) into the communicating state (open state).

Further, the controller 1 makes the syringe 8 perform injection of the ink. The controller 1 rotates the syringe motor 85 to move the movable member 82 downward. Thereby, pressure is applied to the ink so that ink can be pushed out of the nozzles 51 of the line head 5.

The damper 9 is formed of, for example, a metal sheet. There is a case where pressure applied to the ink in the forcible ink discharge processing causes swelling of the damper 9. This deformation increases the inner capacity of the damper 9.

For example, assume a case where, in the forcible ink discharge processing, ink of an amount of X mL is injected from the syringe 8 into the damper 9. Here, assume that the damper 9 is deformed such that the amount of ink held in the damper 9 increases by Y mL. Then, the amount of ink discharged in the forcible ink discharge processing is (X-Y) mL. In this case, it may be difficult to achieve a sufficient cleaning effect through the forcible ink discharge processing. Further, the amount of ink discharged in the forcible ink discharge processing may be reduced, and it may become difficult to appropriately manage the amount of residual ink.

To deal with such inconvenience, the printer 100 has a measurement mode. The measurement mode is a mode for measuring a variation amount 21 (an increase amount) of the ink capacity of the damper 9 caused by the deformation. Through this measurement, the controller 1 determines (recognizes) the variation amount 21. Here, the ink might leak from the nozzles 51 in the measurement mode. In case of such ink leakage, the controller 1 puts the ink receiving tray below the head line 5.

(Processing in Measurement Mode)

Next, a description will be given of an example of the flow of processing in the measurement mode according to the embodiment, with reference to FIG. 8 to FIG. 12. The processing performed in the measurement mode is broadly divided into three kinds of processing, namely, pressure applying processing, pressure releasing processing, and liquid surface lowering processing. After the pressure releasing processing is performed lastly, the liquid surface lowering processing is performed. Measurement is performed with respect to each line head 5 (ink replenisher 6).

Figure 8:
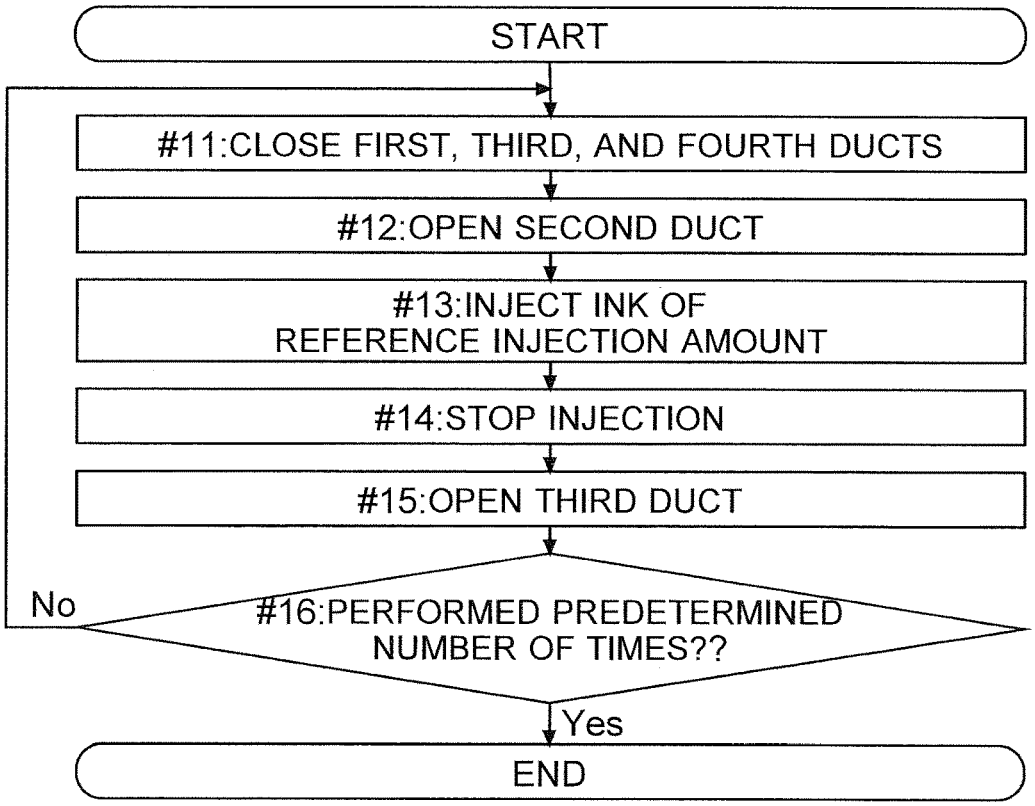
FIG. 8 is a diagram showing an example of pressure applying processing and pressure releasing processing according to the embodiment.
Figure 9:
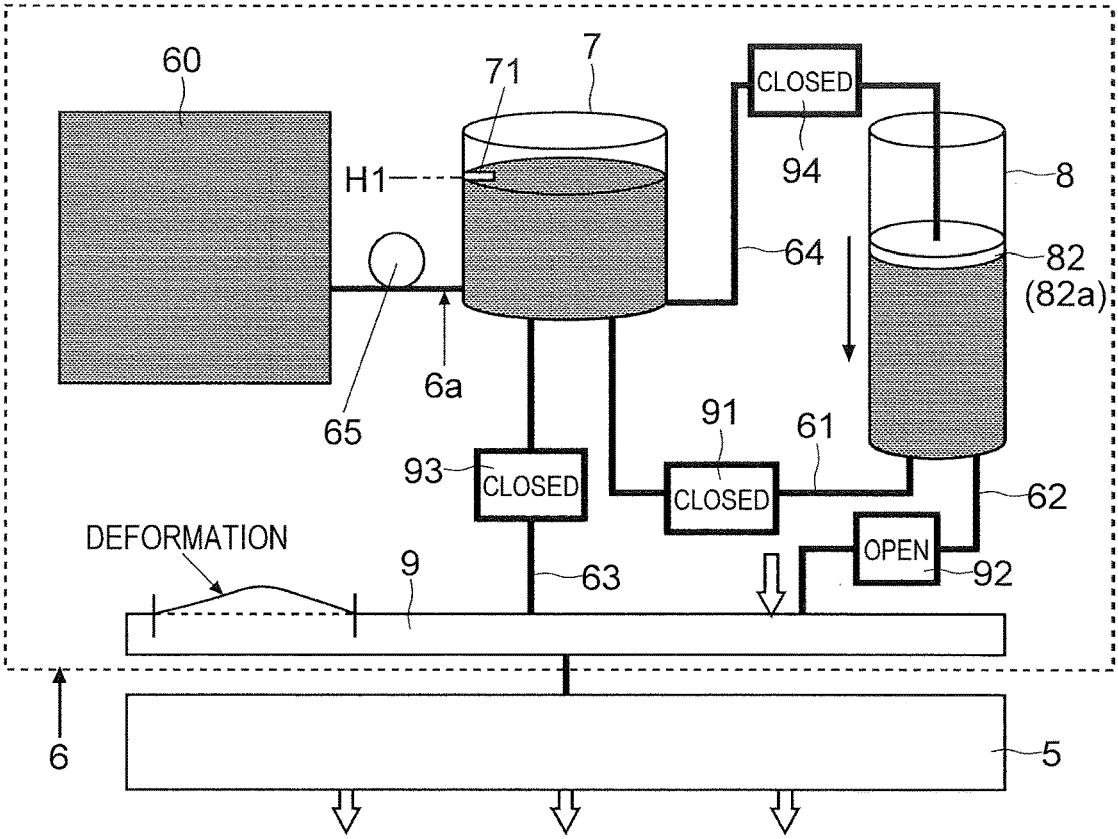
FIG. 9 is a diagram showing the example of the pressure applying processing and the pressure releasing processing according to the embodiment.
Figure 10:
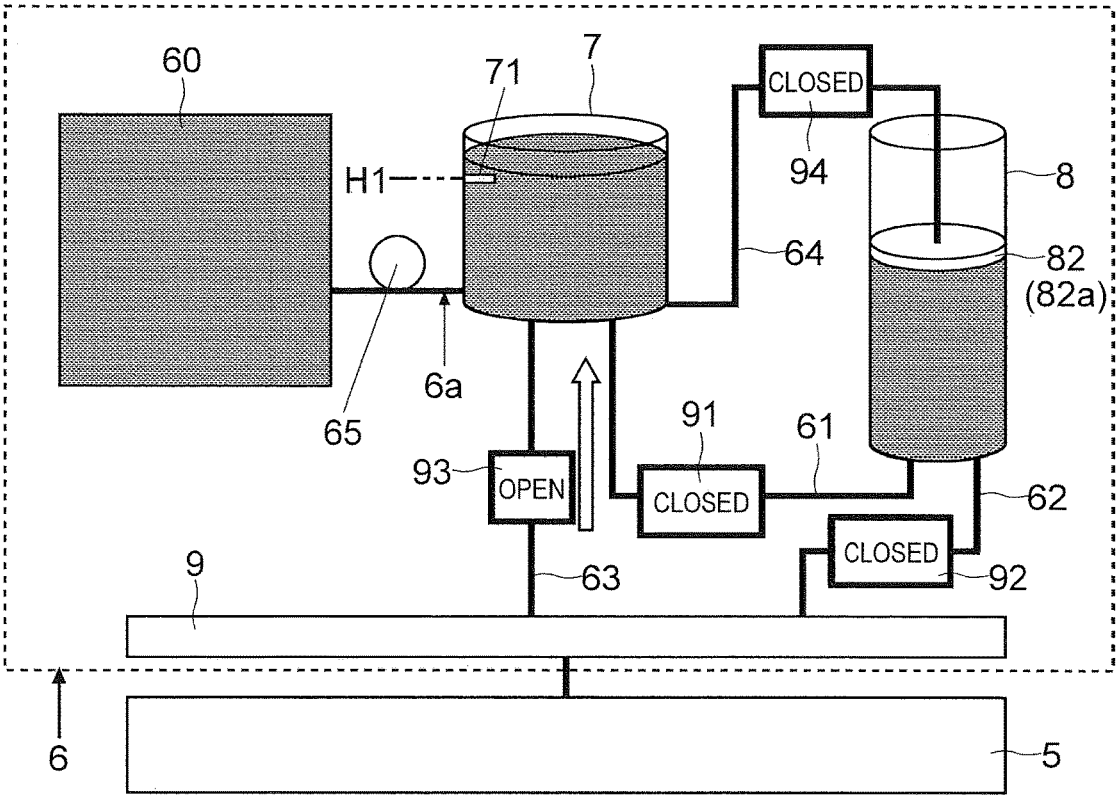
FIG. 10 is a diagram showing the example of the pressure applying processing and the pressure releasing processing according to the embodiment.

First, with reference to FIG. 8 to FIG. 10, an example of the pressure applying processing and an example of the pressure releasing processing will be described. "START" in FIG. 8 indicates a time point when the measurement is started. That is, it is a time point when the controller 1 starts measuring the variation amount 21. The operation panel 3 accepts starting of the measurement mode. To have the measurement of the variation amount 21 started, a user performs a predetermined operation on the operation panel 3. In response to the operation panel 3 accepting the starting of the measurement mode, the controller 1 starts the processing shown in the flowchart of FIG. 8.

First, the controller 1 closes the first duct 61, the third duct 63, and the fourth duct 64 (step #11). In other words, the controller 1 makes the first opening-closing portion 91, the third opening-closing portion 93, and the fourth opening-closing portion 94 operate to cut off the first duct 61, the third duct 63, and the fourth duct 64 (see FIG. 9). Further, the controller 1 opens the second duct 62 (step #12). In other words, the controller 1 makes the second opening-closing portion 92 operate to bring the second duct 62 into the communicating state (see FIG. 9).

Next, the controller 1 makes the syringe 8 perform injection of the ink of a reference injection amount 22 (step #13). The controller 1 makes the movable member 82 move in the direction (downward direction) in which the ink is to be injected. Since the second duct 62 is open, the ink is injected into the damper 9 (see a white arrow in FIG. 9). The controller 1 makes the syringe motor 85 rotate to move the movable member 82 move in the direction in which the ink is to be injected. Each white arrow in FIG. 9 indicates the flow of ink caused by the syringe 8. A solid arrow in FIG. 9 indicates a direction in which the movable member 82 moves.

The reference injection amount 22 is determined in advance. For example, through an experiment, there is determined a preferable total amount of ink to be discharged from the nozzles 51 to achieve a satisfactory cleaning performance. The determined total amount can be used as the reference injection amount 22. The storage media 2 stores the reference injection amount 22 in a nonvolatile manner (see FIG. 1).

After the injection (pushing out) of the ink performed by the syringe 8, the controller 1 starts the pressure releasing processing. First, the controller 1 makes the syringe 8 stop performing the injection of the ink (step #14). Further, the controller 1 opens the third duct 63 (step #15). The controller 1 makes the third opening-closing portion 93 operate to bring the flow path of the third duct 63 into the communicating state (see FIG. 10). Here, the controller 1 may close, or may open, the first duct 61, the second duct 62, and the fourth duct 64. In FIG. 10, the ducts are closed. The first, second, and fourth ducts 61, 62, and 64 may be opened or closed, as long as the ink of the variation amount 21 is allowed to flow (return) into the tank 7. Through step #14 and step #15, the pressure applied to the ink is released. The damper 9, having been distorted (deformed), recovers its original shape. As a result, the ink of the variation amount 21 attributable to the deformation is returned into the tank 7 (see the white arrow in FIG. 10). As a result, the liquid surface in the tank 7 rises. The height (position) of the liquid surface is above the reference position H1.

Then, the controller 1 confirms whether or not the combination of the pressure applying processing and the pressure releasing processing has been performed a predetermined number of execution times (step #16). When the number of times the combination of the pressure applying processing and the pressure releasing processing has been performed is found to have reached the predetermined number of execution times (Yes in step #16), the present flow ends (END). When the number of times the combination of the pressure applying processing and the pressure releasing processing has been performed is found not to have reached the predetermined number of execution times (No in step #16), the flow returns to step #11.

The number of execution times the combination of the pressure applying processing and the pressure releasing processing is to be performed may be one time, or may be a plurality of times. The operation panel 3 accepts a setting of the number of execution times the combination of the pressure applying processing and the pressure releasing processing is to be performed. The controller 1 performs the combination of the pressure applying processing and the pressure releasing processing the set number of execution times. In a case where the set number of execution times is one time, the present flow ends when each of the pressure applying processing and the pressure releasing processing has been performed one time. In a case where the set number of times is a plurality of times, the present flow ends when the combination of the pressure applying processing and the pressure releasing processing has been repeated the plurality of times.

Figure 11:
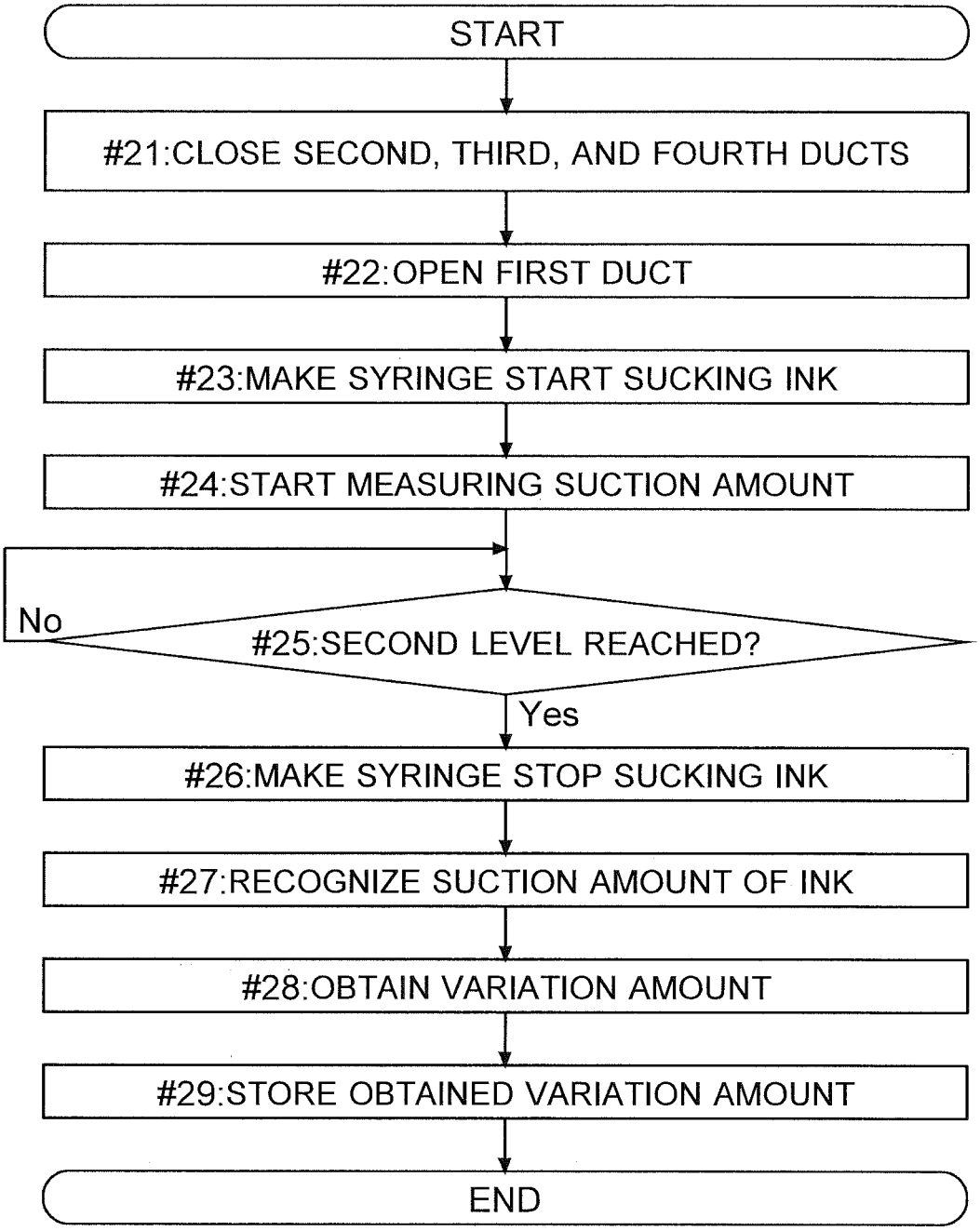
FIG. 11 is a diagram showing an example of liquid surface lowering processing according to the embodiment.
Figure 12:
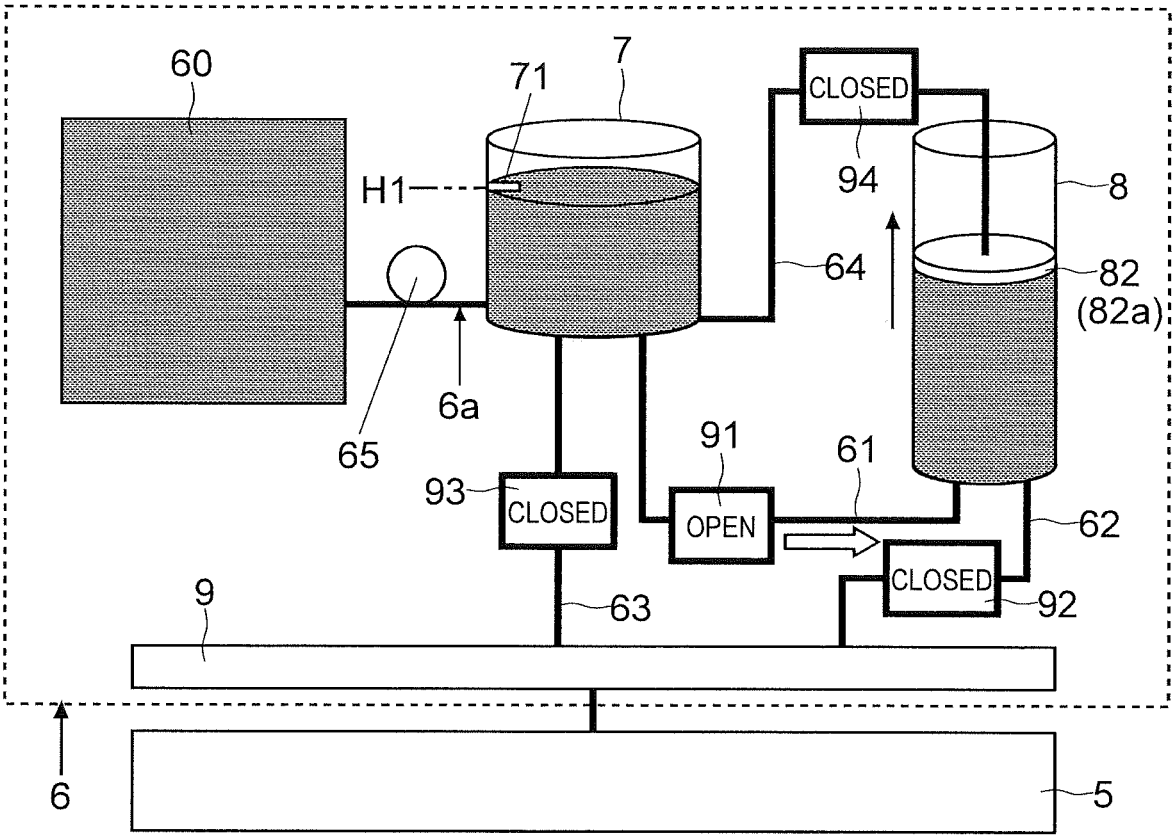
FIG. 12 is a diagram showing the example of the liquid surface lowering processing according to the embodiment.

Next, with reference to FIG. 11 and FIG. 12, an example of the liquid surface lowering processing will be described. "START" in FIG. 11 is the time point at which the flowchart of FIG. 8 is finished.

First, the controller 1 closes the second duct 62, the third duct 63, and the fourth duct 64 (step #21). The controller 1 makes the second opening-closing portion 92 operate to bring the flow path of the second duct 62 into the cut-off state. This prevents the ink from being conveyed between the syringe 8 and the damper 9. Further, the controller 1 makes the third opening-closing portion 93 operate to cut off the flow path of the third duct 63. This prevents the ink from being conveyed between the damper 9 and the tank 7.

Further, the controller 1 makes the fourth opening-closing portion 94 operate to block the flow of air in the fourth duct 64.

Next, the controller 1 opens the first duct 61 (step #22). The controller 1 makes the first opening-closing portion 91 operate to bring the first duct 61 into the communicating state. This allows the ink to be conveyed between the tank 7 and the syringe 8. FIG. 12 shows the open state and the closed state of the ducts in the liquid surface lowering processing.

Next, the controller 1 makes the syringe 8 start performing the suction of the ink (step #23). The controller 1 makes the movable member 82 move in the direction (upward direction) in which the ink is to be sucked. The controller 1 makes the syringe motor 85 rotate to make the movable member 82 move in the direction in which the ink is to be sucked. The white arrow in FIG. 12 indicates the flow of ink caused by the syringe 8. The solid arrow in FIG. 12 indicates a direction in which the movable member 82 moves.

Simultaneously with the suction of the ink, the controller 1 starts measuring a suction amount of ink (step #24). For example, the controller 1 counts the number of rotations of the syringe motor 85. The suction amount of ink per rotation of the syringe motor 85 is fixed. The controller 1 measures the suction amount of ink based on the number of rotations or the rotation angle of the syringe motor 85 counted or measured from the start of the suction of the ink.

The controller 1 continues to confirm whether or not the output level of the liquid surface sensor 71 has become the second level (step #25, No in step #25→step #25). In other words, the controller 1 confirms whether or not the syringe 8 has sucked the ink of an amount sufficient to lower the position of the liquid surface in the tank 7 to or below the reference position H1. The controller 1 makes the syringe 8 continue to perform the suction of the ink until the liquid surface in the tank 7 falls to or below the reference position H1. Note that, in the measurement mode, even when the output level of the liquid surface sensor 71 becomes the second level, the controller 1 does not immediately start replenishing the ink into the tank 7 (that is, does not make the pump 65 operate).

When the output level of he liquid surface sensor 71 has become the second level (Yes in step #25), the controller 1 makes the syringe 8 stop the suction of the ink (step #26). That is, the controller 1 makes the syringe motor 85 stop rotating.

The controller 1 recognizes the amount of ink sucked by the syringe 8 from the start of the suction of the ink until the output level of the liquid surface sensor 71 changes to the second level (step #27). Thereby, the controller 1 recognizes the amount of ink having been sent into the tank 7 through the pressure applying processing and the pressure releasing processing after the start of the measurement mode. For example, when the suction amount of ink per rotation of the syringe motor 85 is A mL, and the number of rotations of the syringe motor 85 from the start of the suction of the ink until the output level of the liquid surface sensor 71 changes to the second level is 7.5 times, the controller 1 recognizes that the suction amount is 7.5 A mL.

Based on the recognized suction amount, the controller 1 obtains the variation amount 21 (increase amount) of the capacity of the damper 9 caused by deformation (step #28). The controller 1 makes the storage media 2 store the thus obtained variation amount 21 in a nonvolatile manner (step #29, see FIG. 1). Then, the present flow is finished (END).

In the case where the number of execution times the combination of the pressure applying processing and the pressure releasing processing is to be performed is one time, the controller 1 recognizes, as the variation amount 21, the suction amount having been recognized in the liquid surface lowering processing.

In the case where the combination of the pressure applying processing and the pressure releasing processing has been repeated a plurality of times (when the number of execution times is a plurality of times), the controller 1 recognizes, as the variation amount 21, a value obtained by dividing the suction amount having been recognized in the liquid surface lowering processing by the number of times the combination has been repeated (the set number of execution times). For example, when the combination is repeated five times, the controller 1 divides the recognized suction amount by five.

(Correction Using Variation Amount 21)

Next, with reference to FIG. 1, a description will be given of an example of correction performed in the printer 100 by using the recognized variation amount 21.

(1) Forcible Ink Discharge Processing

In the forcible ink discharge processing, the syringe 8 injects ink into the damper 9. With pressure applied thereto, the damper 9 becomes deformed (swollen), as a result of which the capacity (the ink capacity) of the damper 9 increases. Due to the deformation of the damper 9, the amount of ink discharged from the nozzles 51 becomes smaller than the reference injection amount 22. To deal with this, the controller 1, based on the variation amount 21, increases the amount of ink to be injected by the syringe 8 in the forcible ink discharge processing.

In the forcible ink discharge processing, the controller 1 closes the first duct 61 and the third duct 63. The controller 1 makes the first opening-closing portion 91 cut off the flow path of the first duct 61. Further, the controller 1 makes the third opening-closing portion 93 cut off the flow path of the third duct 63. Here, the controller 1 may make the syringe 8 inject, toward the damper 9, the ink of an amount equal to the sum of the reference injection amount 22 and the variation amount 21. Thereby, even when the damper 9 is deformed, the total amount of ink discharged from the nozzles 51 is equal to the reference injection amount 22.

(2) Management of Ink Consumption

The storage media 2 stores a cumulative consumption amount 23 in a nonvolatile manner (see FIG. 1). The cumulative consumption amount 23 is, for example, data for managing the amount of ink consumed from when a new ink container 60 is installed until a current time point. For example, when a value obtained by subtracting the cumulative consumption amount 23 from the full ink capacity of the ink container 60 is found to be equal to or smaller than a predetermined value, the controller 1 makes the display panel 31 display a notification that only a small amount of ink remains in the ink container 60. Thus, it is possible to notify the user that the ink container 60 will need to be replaced before long.

In the forcible ink discharge processing, ink is consumed. To the cumulative consumption amount 23, the amount of ink consumed in the forcible ink discharge processing needs to be added. When the forcible ink discharge processing has been performed, the controller 1 makes the storage media 2 update the cumulative consumption amount 23. When ink of an amount (an addition amount) equal to the sum of the reference injection amount 22 and the variation amount 21 has been injected into the damper 9, the controller 1 makes the storage media 2 store the sum of the cumulative consumption amount 23 before update and the reference injection amount 22 as a new cumulative consumption amount 23.

When the controller 1 has made the syringe 8 perform the injection of the ink of only the reference injection amount 22, the controller 1 makes the storage media 2 store the sum of the cumulative consumption amount 23 before update and a subtraction value as a new cumulative consumption amount 23. The subtraction value is a value obtained by subtracting the variation amount 21 from the reference injection amount 22.

As has been described above, the image forming apparatus (the printer 100) according to the embodiment includes the head 50, the tank 7, the syringe 8, the damper 9, the first duct 61, the second duct 62, the third duct 63, the liquid surface sensor 71, and the controller 1. The head 50 performs printing by ejecting ink. The tank 7 stores the ink therein. The syringe 8 performs injection or suction of the ink. The damper 9 supplies the ink to the head 50, and the ink is injected into the damper 9 from the syringe 8. The first duct 61 is a flow path that connects the tank 7 and the syringe 8 to each other for conveyance of the ink between the tank 7 and the syringe 8. The second duct 62 is a flow path that connects the syringe 8 and the damper 9 to each other for conveyance of the ink between the syringe 8 and the damper 9. The third duct 63 is a flow path that connects the damper 9 and the tank 7 to each other for conveyance of the ink between the damper 9 and the tank 7. The liquid surface sensor 71 senses whether or not the liquid surface of ink in the tank 7 is located at or below the reference position H1. The controller 1 receives an output of the liquid surface sensor 71. In the measurement mode, in which the variation amount 21 indicating an amount of variation in ink capacity of the damper 9 caused by deformation of the damper 9 is measured, the controller 1 performs the pressure applying processing, the pressure releasing processing, and the liquid surface lowering processing. The controller 1 performs the pressure releasing processing after the pressure applying processing. In the pressure applying processing, the controller 1 closes the first duct 61 and the third duct 63. Then, the controller 1 makes the syringe 8 inject ink into the damper 9 to deform the damper 9. After the damper 9 is deformed, in the pressure releasing processing, the controller 1 makes the syringe 8 stop injecting ink into the damper 9. The controller 1 opens the third duct 63. After the pressure releasing processing, the controller 1 performs the liquid surface lowering processing. In the liquid surface lowering processing, the controller 1 closes the second duct 62 and the third duct 63. The controller 1, with the first duct 61 open, makes the syringe 8 such the ink from the tank 7. The controller 1 recognizes the suction amount of ink sucked by the syringe 8 from the start of the suction of the ink until the output of the liquid surface sensor 71 changes. Based on the recognized suction amount, the controller 1 determines the variation amount 21.

The pressure applying processing makes it possible to intentionally apply pressure to the ink to cause deformation of the damper 9. The pressure releasing processing makes it possible to return, into the tank 7, the ink of the variation amount 21 which indicates an amount of variation in ink capacity of the damper 9 (that is, the ink of an amount equal to the variation amount 21 indicating an amount of variation in ink capacity of the damper 9 caused by deformation of the damper 9). It is possible to measure the variation amount 21 based on the amount of ink sucked by the syringe 8 until the height of the liquid surface in the tank 7 which has been caused to rise by the ink returned into the tank 7 lowers to the reference position H1. It is possible to obtain a correct variation amount 21.

In the measurement mode, the controller 1 may perform each of the pressure applying processing and the pressure releasing processing one time. In this case, the controller 1 recognizes, as the variation amount 21, the suction amount recognized in the liquid surface lowering processing. By performing each of the pressure applying processing, the pressure releasing processing, and the liquid surface lowering processing just one time, the variation amount 21 can be obtained (measured). Thus, it is possible to quickly measure the variation amount 21 in a minimum time.

Further, in the measurement mode, the controller 1 may repeat the combination of the pressure applying processing and the pressure releasing processing a plurality of times. In this case, the controller 1 starts the liquid surface lowering processing when the pressure releasing processing performed lastly is finished. The controller 1 recognizes, as the variation amount 21, a value obtained by dividing the suction amount recognized in the liquid surface lowering processing by the number of times the combination has been performed. That is, the average value of the measurements performed the plurality of times can be obtained as the variation amount 21. It is possible to obtain the variation amount 21 as the average value of amounts of ink returned into the tank 7 in the pressure applying processing and the pressure releasing processing performed the plurality of times. By calculating the average value, it is possible to obtain an accurate value as the variation amount 21.

The image forming apparatus (the printer 100) includes the first opening-closing portion 91 which performs switching between the open state and the closed state of the first duct 61, the second opening-closing portion 92 which performs switching between the open state and the closed state of the second duct 62, and the third opening-closing portion 93 which performs switching between the opens state and the closed state of the third duct 63. Thus, it is possible to control opening and closing (communicating state and cut-off state) of each of the first duct 61, the second duct 62, and the third duct 63.

The reference injection amount 22 of ink to be injected from the syringe 8 into the damper 9 in the forcible ink discharge processing, in which ink is forcibly discharged from the head 50, is determined in advance. When performing the forcible ink discharge processing, the controller 1 closes the first duct 61 and the third duct 63. When injecting ink into the damper 9, the controller 1 may make the syringe 8 inject an amount equal to the sum of the reference injection amount 22 and the variation amount 21. In the forcible ink discharge processing, even if the damper 9 is deformed, it is possible to have ink of a fixed amount forcibly discharged from the damper 9. Even with individual differences between the dampers 9 in terms of deformation, it is possible to have ink of a fixed amount (the reference injection amount 22) forcibly discharged from the dampers 9.

The image forming apparatus includes the storage media 2 in which the cumulative consumption amount 23 is stored. When the forcible ink discharge processing is performed, the controller 1 closes the first duct 61 and the third duct 63. When the syringe 8 has injected, into the damper 9, ink of an amount equal to the sum of the reference injection amount 22 and the variation amount 2, the controller 1 makes the storage media 2 update the cumulative consumption amount 23 by adding the reference injection amount 22 to it. When the syringe 8 has injected, into the damper 9, ink of an amount equal to the reference injection amount 22, the controller 1 makes the storage media 2 update the cumulative consumption amount 23 by adding thereto a value obtained by subtracting the variation amount 21 from the reference injection amount 22. Thus, it is possible to accurately manage the amount of ink having been consumed in the image forming apparatus. Such accurate management of the cumulative consumption amount 23 makes it possible to make known an accurate remaining amount of ink. Moreover, it is possible to make an accurate notification that the amount of remaining ink has decreased.

It should be understood that the embodiments of the present disclosure described above are in no way meant to limit its scope; the present disclosure can be implemented with any modifications made without departing from its spirit.

What is claimed is:

1. An image forming apparatus comprising:

a head which performs printing by ejecting ink;

a tank which stores the ink therein;

a syringe which performs injection or suction of the ink;

a damper which supplies the ink to the head, and into which the ink is injected from the syringe;

a first duct which is a flow path that connects the tank and the syringe to each other for conveyance of the ink between the tank and the syringe;

a second duct which is a flow path that connects the syringe and the damper to each other for conveyance of the ink between the syringe and the damper;

a third duct which is a flow path that connects the damper and the tank to each other for conveyance of the ink between the damper and the tank;

a liquid surface sensor which senses whether or not a liquid surface of the ink in the tank is located at or below a reference position; and a controller which receives an output of the liquid surface sensor, wherein, in a measurement mode, in which a variation amount indicating an amount of variation in ink capacity of the damper caused by deformation of the damper is measured, the controller performs pressure applying processing, pressure releasing processing, and liquid surface lowering processing, performs the pressure releasing processing after the pressure applying processing, in the pressure applying processing, closes the first duct and the third duct, and then makes the syringe perform the injection of the ink into the damper to cause deformation of the damper, after the damper is deformed, in the pressure releasing processing, makes the syringe stop injecting the ink into the damper, and opens the third duct, after the pressure releasing processing, performs the liquid surface lowering processing, in the liquid surface lowering processing, closes the second duct and the third duct, makes the syringe perform the suction of the ink from the tank, with the first duct open, and recognizes a suction amount of the ink sucked by the syringe from a start of the suction of the ink until an output of the liquid surface sensor changes, and determines the variation amount based on the suction amount recognized.

2. The image forming apparatus according to claim 1, wherein, in the measurement mode, the controller performs each of the pressure applying processing and the pressure releasing processing one time, and recognizes, as the variation amount, the suction amount having been recognized in the liquid surface lowering processing.

3. The image forming apparatus according to claim 1, wherein, in the measurement mode, the controller performs a combination of the pressure applying processing and the pressure releasing processing a plurality of times, starts the liquid surface lowering processing when a last performance of the pressure releasing processing is finished, and recognizes, as the variation amount, a value obtained by dividing the suction amount having been recognized in the liquid surface lowering processing by a number of times the combination has been performed.

4. The image forming apparatus according to claim 1, further comprising:

a first opening-closing portion which performs switching between an open state and a closed state of the first duct;

a second opening-closing portion which performs switching between an open state and a closed state of the second duct; and a third opening-closing portion which performs switching between an open state and a closed state of the third duct.

5. The image forming apparatus according to claim 1, wherein a reference injection amount of the ink to be injected from the syringe into the damper in forcible ink discharge processing, in which the ink is forcibly discharged from the head, is determined in advance, and in a case where the forcible ink discharge processing is performed, the controller closes the first duct and the third duct, and makes the syringe inject, into the damper, the ink of an amount equal to a sum of the reference injection amount and the variation amount.

6. The image forming apparatus according to claim 1, further comprising a storage media which stores a cumulative consumption amount therein, wherein a reference injection amount of the ink to be injected from the syringe into the damper in forcible ink discharge processing, in which the ink is forcibly discharged from the head, is determined in advance, and in a case where the forcible ink discharge processing is performed, the controller closes the first duct and the third duct, makes the storage media update the cumulative consumption amount by adding the reference injection amount to the cumulative consumption amount, in a case where the syringe has injected, into the damper, the ink of an amount equal to a sum of the reference injection amount and the variation amount, and makes the storage media update the cumulative consumption amount by adding, to the cumulative consumption amount, a value obtained by subtracting the variation amount from the reference injection amount, in a case where the syringe has injected, into the damper, the ink of the reference injection amount.

7. The image forming apparatus according to claim 1, further comprising a first opening-closing motor and a first opening-closing cam, wherein the first duct is a rubber tube, to open the first duct, the controller rotates the first opening-closing motor to rotate the first opening-closing cam by a rotation angle that does not cause the first opening-closing cam to squeeze the first duct, and to close the first duct, the controller rotates the first opening-closing motor to rotate the first opening-closing cam by a rotation angle that causes the first opening-closing cam to squeeze the first duct.

8. The image forming apparatus according to claim 7, further comprising a second opening-closing motor and a second opening-closing cam, wherein the second duct is a rubber tube, to open the second duct, the controller rotates the second opening-closing motor to rotate the second opening-closing cam by a rotation angle that does not cause the second opening-closing cam to squeeze the second duct, and to close the second duct, the controller rotates the second opening-closing motor to rotate the second opening-closing cam by a rotation angle that causes the second opening-closing cam to squeeze the second duct.

9. The image forming apparatus according to claim 8, further comprising a third opening-closing motor and a third opening-closing cam, wherein the third duct is a rubber tube, to open the third duct, the controller rotates the third opening-closing motor to rotate the third opening-closing cam by a rotation angle that does not cause the third opening-closing cam to squeeze the third duct, and to close the third duct, the controller rotates the third opening-closing motor to rotate the third opening-closing cam by a rotation angle that causes the third opening-closing cam to squeeze the third duct.

10. A method for controlling an image forming apparatus, the method comprising:

performing printing by ejecting ink from a head;

storing the ink in a tank;

performing injection or suction of the ink by using a syringe;

supplying the ink from a damper to the head, and injecting the ink from the syringe into the damper;

a first duct connecting the tank and the syringe to each other;

a second duct connecting the syringe and the damper to each other;

a third duct connecting the damper and the tank to each other;

sensing, by using a liquid surface sensor, whether or not a liquid surface of the ink in the tank is located at or below a reference position;

performing pressure applying processing, pressure releasing processing, and liquid surface lowering processing in a measurement mode, in which a variation amount indicating an amount of variation in ink capacity of the damper caused by deformation of the damper is measured;

performing the pressure releasing processing after the pressure applying processing;

in the pressure applying processing, closing the first duct and the third duct and then the syringe performing the injection of the ink into the damper to deform the damper;

in the pressure releasing processing performed after the damper is deformed, the syringe stopping the injection of the ink into the damper, and opening the third duct;

performing the liquid surface lowering processing after the pressure releasing processing;

in the liquid surface lowering processing, closing the second duct and the third duct, the syringe performing the suction of the ink from the tank with the first duct open, and recognizing a suction amount of the ink sucked by the syringe from a start of the suction until an output of the liquid surface sensor changes; and determining the variation amount based on the suction amount recognized.

* * * * *